US006831257B2

(12) United States Patent
Walker

(10) Patent No.: US 6,831,257 B2
(45) Date of Patent: Dec. 14, 2004

(54) CONTROL SYSTEM FOR MULTIPLE HEATING TOWERS A METHOD FOR HEATING LIQUIDS AND DISTRIBUTING OPERATING WEAR AMONGST A PLURALITY OF HEATING TOWERS

(75) Inventor: Brian Keith Walker, Broken Arrow, OK (US)

(73) Assignee: Quikwater, Inc., Sand Springs, OK (US)

( * ) Notice: Subject to any disclaimer, the term of this patent is extended or adjusted under 35 U.S.C. 154(b) by 301 days.

(21) Appl. No.: 10/095,406

(22) Filed: Mar. 11, 2002

(65) Prior Publication Data

US 2002/0190056 A1 Dec. 19, 2002

Related U.S. Application Data

(60) Provisional application No. 60/274,454, filed on Mar. 9, 2001.

(51) Int. Cl.[7] ..... H05B 1/02

(52) U.S. Cl. ..... 219/486; 219/485; 219/497; 219/494; 236/20 R; 392/441

(58) Field of Search ..... 219/486, 483–485, 219/490, 491, 494, 497, 506, 492, 481; 236/20 R, 46 R, 47, 361, 25 R; 392/441, 445, 454

(56) References Cited

U.S. PATENT DOCUMENTS

| | | | | | |
|---|---|---|---|---|---|
| 3,964,466 | A | * | 6/1976 | Ohringer | 122/13.3 |
| 4,242,078 | A | * | 12/1980 | Nelson et al. | 431/45 |
| 4,620,667 | A | * | 11/1986 | Vandermeyden et al. | 236/20 R |
| 5,056,712 | A | * | 10/1991 | Enck | 236/20 R |
| 5,831,345 | A | * | 11/1998 | Michaud | 307/38 |
| 6,536,678 | B2 | * | 3/2003 | Pouchak | 237/7 |

* cited by examiner

*Primary Examiner*—Mark Paschall
(74) *Attorney, Agent, or Firm*—Cherskov & Flaynik

(57) ABSTRACT

The present invention is a system that automatically controls the selection, start-up and operation of primary and secondary heating towers chosen from an array of heating towers having varying physical and thermal sizes. The automatic control is implemented via a programmable logic controllers (PLC). The PLC provides independent control for each heating tower irrespective of the tower being a primary or secondary heating source. Should the demand for heated water upon the primary heating tower increase to a rate that the primary tower cannot satisfy, the PLC maintains the operation of the primary tower and at the same time starts the secondary heating tower to meet the increased hot water demand. Once the demand has dropped to rates that the primary heating tower can once again maintain, the secondary tower is disabled.

49 Claims, 4 Drawing Sheets

CONTROL SYSTEM FOR MULTIPLE HEATING TOWERS A METHOD FOR HEATING LIQUIDS AND DISTRIBUTING OPERATING WEAR AMONGST A PLURALITY OF HEATING TOWERS

This application is based on U.S. Provisional Application No. 60/274,454 filed on Mar. 9, 2001.

BACKGROUND OF THE INVENTION

1. Field of the Invention

The present invention relates to heating towers that provide heated water to satisfy a predetermined flow demand and more particularly, to a system that selects primary and secondary heating towers from a plurality of heating towers to satisfy the flow demand.

2. Background of the Prior Art

Control systems that start-up, operation and shut-down heating towers are commonly used. The control technologies use electrical relays with discrete components, programable logic controllers (PLC) and computers. The systems developed to control the heating towers include the use of dedicated primary and secondary heating towers to satisfy flow demands at a predetermined temperature. Generally, the dedicated secondary heating tower starts and stops correspondingly with flow demand or based upon other predetermined parameters. Dedicated primary heating towers are not used as secondary heating towers even if the primary tower would be less expensive to operate as a secondary tower. Further, irrespective of the wear and time of operation on the dedicated primary towers, a dedicated secondary tower is not used as a replacement for the primary towers.

The problem with the prior art heating tower control systems is that the systems do not have the flexibility to select any available tower as either a primary tower or a secondary tower. Not having this flexibility increases the quantity of heating fuel ultimately used to heat liquids (water) required to satisfy flow demand rates. The increased fuel use results from less available turndown ratio for multiple heating towers (turndown being the additive capacity of all heating towers combined divided by the minimum fire capacity-low firing rate of the smallest heating tower). Also, the wear and fatigue that develops upon a primary heating tower in continuous use cannot but distributed to less used towers, but instead increases until the respective dedicated primary tower unexpectedly fails.

A need exists for a control system for heating towers that allows any tower of a plurality of heating towers to be selected as either a primary or secondary heating tower. The control system must be able to select single or multiple heating towers as being primary or secondary. Further, the selection of any heating tower for use must be based upon parameters that quantify heating tower wear. Also, the control system must be capable of starting and stopping secondary heating towers based upon flow demand thereby reducing cost for heating the liquid.

SUMMARY OF THE INVENTION

It is an object of the present invention to overcome many of the disadvantages associated with control systems for heating towers.

A principle object of the present invention is to provide a system that independently controls heating towers irrespective of the tower being a primary or secondary heating source. A feature of the system is that no heating tower is permanently designated as primary or secondary. An advantage of the system is that the turndown ratio, being defined as the maximum high fire (the additive capacity of all heating towers combined)/the minimum fire capacity (low firing rate of the smallest heating tower), is increased thereby reducing fuel consumption when heating liquids (water) to satisfy flow demand.

Another object of the present invention is to alternate the selection of primary and secondary heating towers amongst all of the heating towers. A feature of the system is to shut down secondary heating towers when flow demand is such that only the primary heating tower need operate to satisfy the flow demand. An advantage of the system is that fuel consumption is reduced. Another advantage of the system is that operating wear is more evenly distributed amongst all the heating towers.

Still another object of the present invention is to select multiple primary and multiple secondary heating towers meet flow demand. A feature of the system selects the heating tower with the smallest heating capacity when satisfying flow demand. An advantage of the system is that operating costs are reduced when satisfying demand.

Yet another object of the present invention is to select primary and secondary heating towers with the least wear. A feature of the system is the collection of fatigue or wear parameters for each heating tower including but not limited to inoperable heating towers, running time, number of stops and starts, number of failures (unexpected shutdown), and the time of day with corresponding low and high flow demand. An advantage of the system is that the useful life of all the heating towers is increased.

Another object of the present invention is to maintain the operation of a selected primary tower while allowing multiple secondary to stop and start depending upon flow demand. A feature of the system is utilize a secondary heating tower that minimally meets flow demand which exceeds the capacity of the primary heating tower. An advantage of the system is that use of heating fuel to satisfy the flow demand is kept to a minimum.

Briefly, the invention provides a control system for multiple heating towers comprising means for selecting at least one of a plurality of heating towers as a primary heating tower; means for starting said selected primary heating tower; means for operating said selected primary heating tower; means for operating at least one of a plurality of heating towers as a secondary heating tower; means for starting said selected secondary heating tower when predetermined demand parameters are required of said selected primary heating tower; and means for operating said selected secondary heating tower.

Further, the invention provides a method for heating liquids and distributing operating wear amongst a plurality of heating towers, said method comprising the steps of determining operable heating towers form a plurality of heating towers; determining initial flow demand; determining the temperature that the initial flow demand is to be heated; selecting at least one primary heating tower from said operable heating towers, said selected primary heating tower satisfying initial flow demand at said determined temperature; starting said selected primary heating tower; operating said selected primary heating tower; determining when flow demand has increased beyond the heating capacity of said primary heating tower; selecting at least one secondary heating tower from said operable heating towers, said selected secondary heating tower satisfying increased flow demand at said determined temperature; starting said selected secondary heating tower; and operating said selected secondary heating tower.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DETAILED DESCRIPTION OF THE PREFERRED EMBODIMENT

Figure 1:
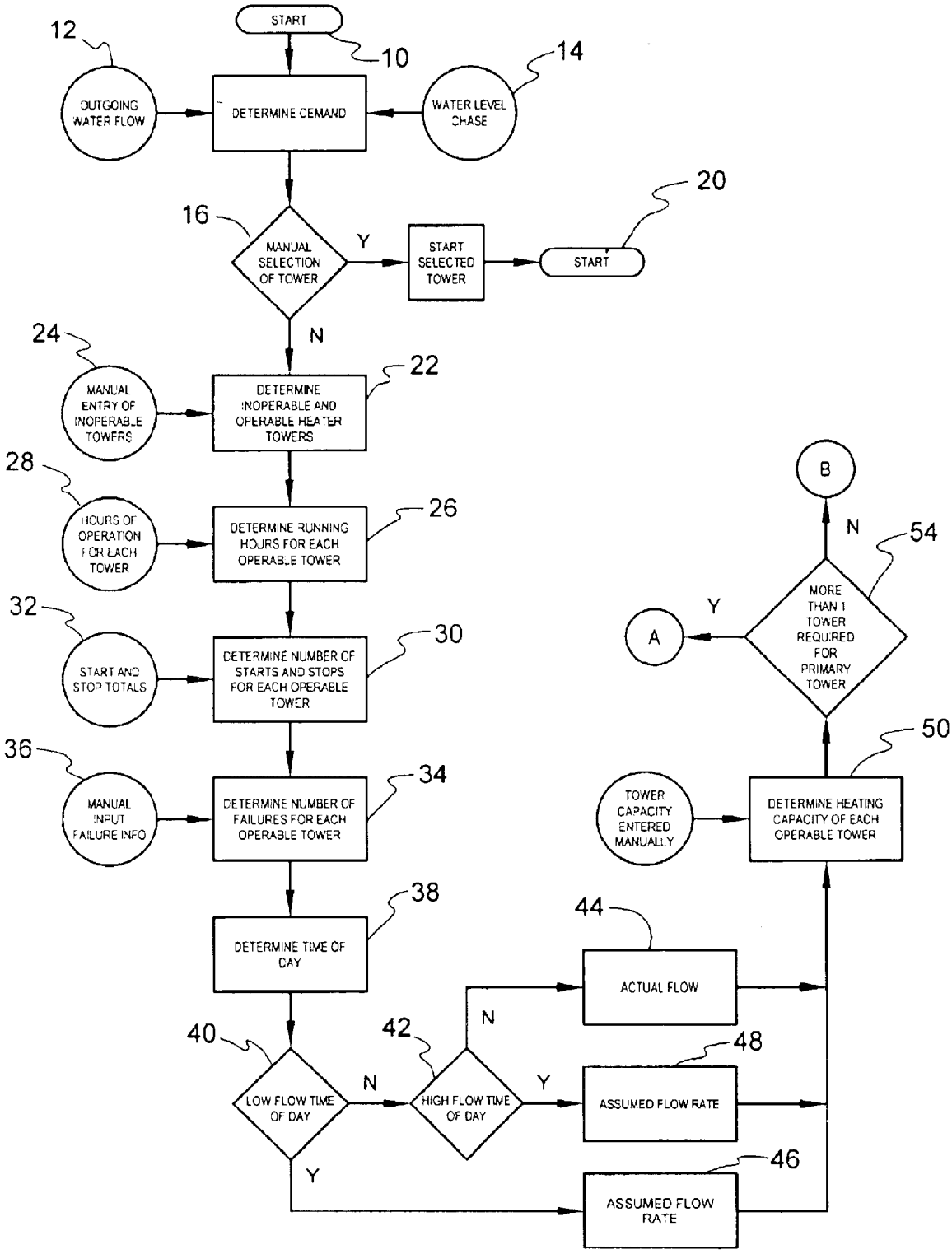
FIG. 1 is a flowchart of a system for selecting at least one primary heating tower from a plurality of heating towers in accordance with the present invention.
Figure 2:
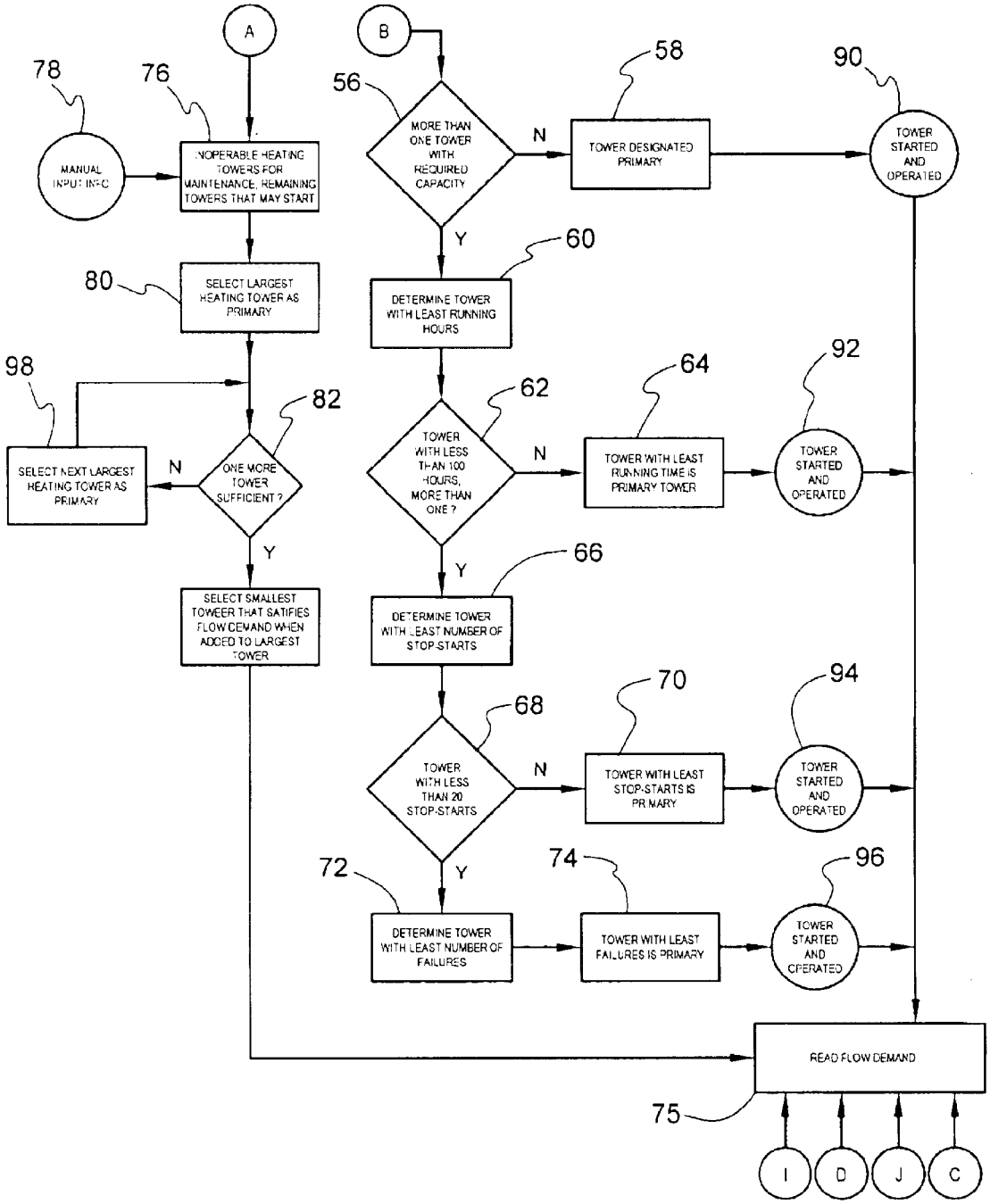
FIG. 2 is a continuation of the flowchart depicted in FIG. 1 in accordance with the present invention.
Figure 3:
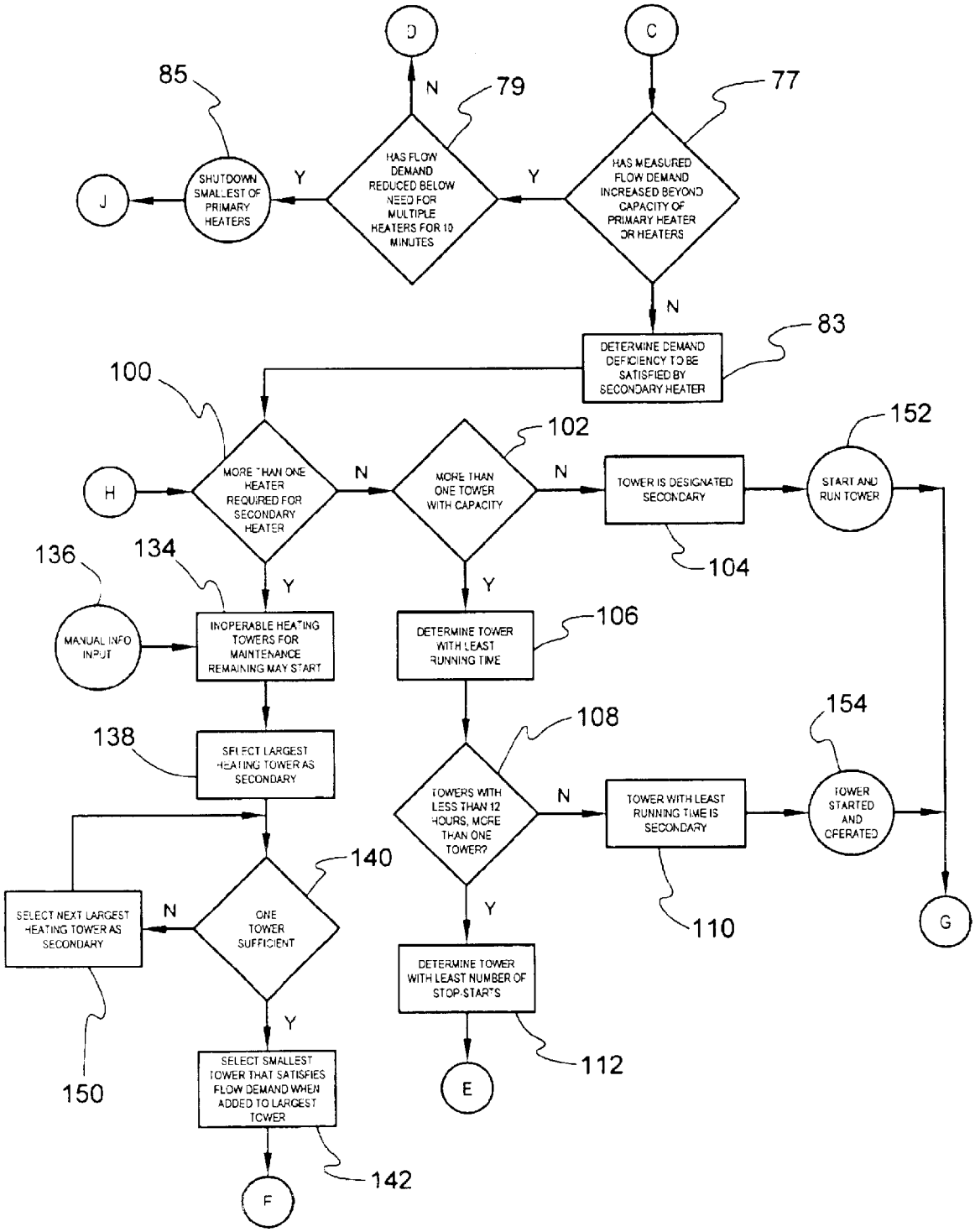
FIG. 3 is a continuation of the flowchart depicted in FIG. 2 in accordance with the present invention.
Figure 4:
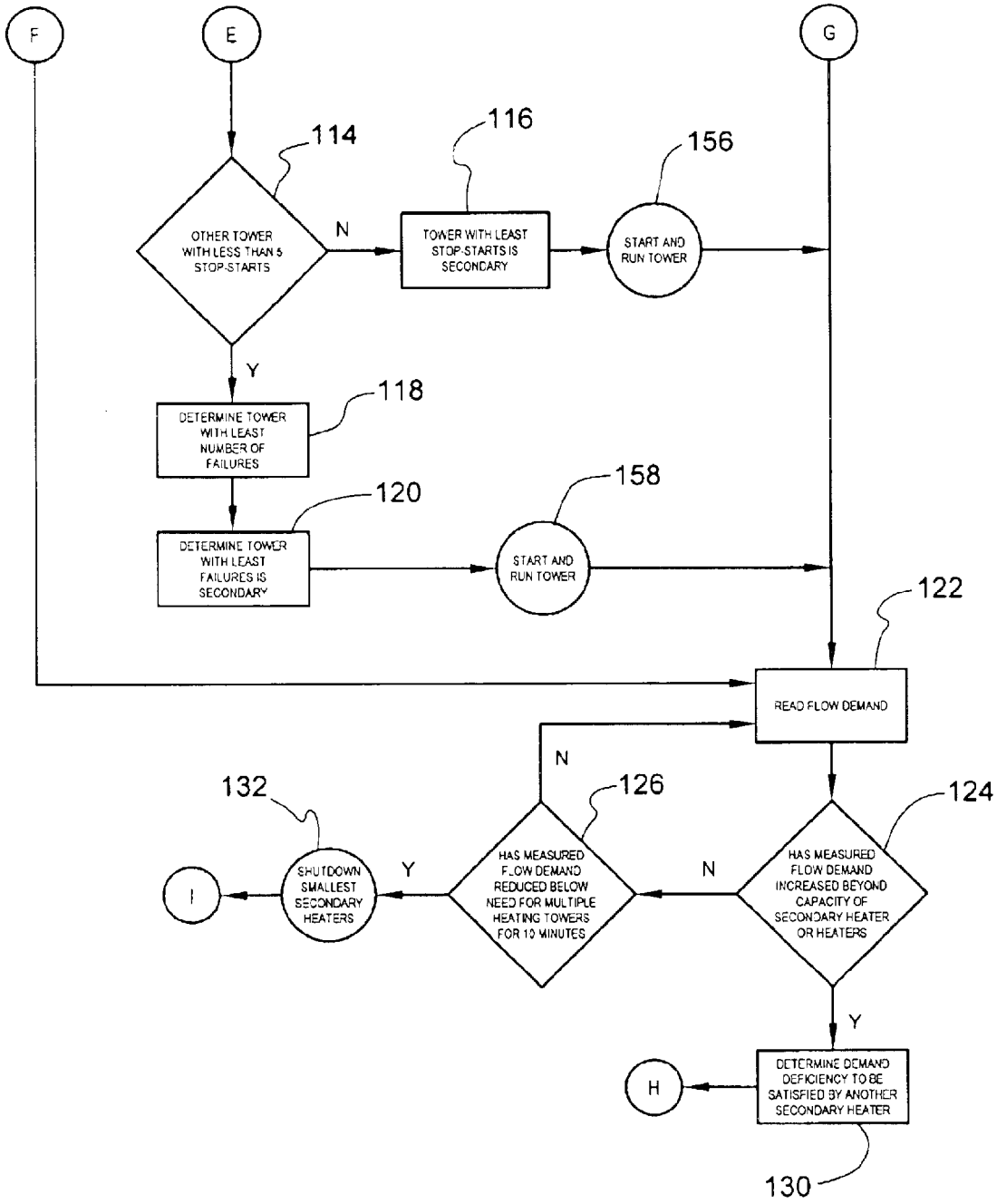
FIG. 4 is a continuation of the flowchart depicted in FIG. 3 in accordance with the present invention.

The present invention is directed to a control system for multiple heating towers and a method for heating liquids and distributing operating wear amongst a plurality of heating towers. The control system may be configured from a myriad of technologies including but not limited to electrical relays, programable logic controllers (PLC's) and computers. These technologies may control separately or in combination to select, start and operate primary and secondary heating towers. Referring now to FIGS. 1–4, a flowchart of a system for multiple heating towers selects at least one primary heating tower from a plurality of heating towers is depicted. At the start 10, a person determines customer demand by reading meters 12 that provide continuous measurements of outgoing water flow, or by reviewing instruments 14 that provide water level change in water storage tanks.

At decision block 16, the person decides whether a primary heating tower is to be manually selected. If not, the controlling technology (a PLC for purposes of this Description) is to select the primary heating tower and proceeds to block 22; if so, the person starts and operates the selected heating tower via the PLC at 18, whereupon, the selection procedure ends at 20 and the PLC continuous operating the selected primary heating tower. The starting and operating control circuitry and corresponding methods of control, are well known to those of ordinary skill in the art and need not be detailed in this description. At block 22, the system examines all heating towers and determines which heating towers are operable and inoperable. The information as to which heating towers are inoperable, is entered via discrete components into the PLC database at block 24. The database having already been provided with information as to all of the plurality of heating towers, the system will readily determine which heating towers are operable. The PLC then determines the total running hours of operation for each operable heating tower at block 26; the hours of operation being input into the PLC data base at block 28 via an electronic timing device, well known to those of ordinary skill, or via manual entry on a periodic bases.

At block 30, the system determines the number of stop and starts of each operable heating tower. The start and stop information being provided to the PLC database at block 32 by one of a myriad components including but not to start-stop buttons, control relays in motor or solenoid circuits, or fuel circuit components that shut off gas flow to the heating towers. At block 34, the system determines the number of failures (unexpected heater tower shutdowns) past and/or present of each operable heating tower. The failure information being manually entered into the PLC database at block 36. At block 38, the system determines the time of day via an internal clock, whereupon, the system at decision block 40 decides if a low flow time of day is present. If not, the system at decision block 42 decides if a high flow time of day is present. If neither a low or high flow time of day is present, the system utilizes flow demand information from the PLC database at block 44. If either a low or high flow time of day is present, the system preemptively sets a corresponding low or high flow demand rate at blocks 46 and 48, respective.

At block 50, the system determines the operable heating towers that have the capacity to supply heated liquid (water) at the required flow demand rates at a predetermined temperature. The capacity of each of the plurality of heating tower having been manually entered into the database of the PLC at block 52. At decision block 54, the system reviews the capacity of all operable heating towers and decides if more than one heating tower is required to satisfy flow demand. If not, the system at decision block 56 decides if more than one tower has the required capacity, if not, that heating tower is selected as the primary heating tower at block 58, the heating tower being started and operated via typical circuitry at block 90. If more than one heating tower has the required capacity, the system at block 60 determines which of the towers has the least running hours.

At decision block 62, the system decides if other towers having sufficient capacity have less than 100 (a number that can vary) hours more run time than the tower with the least running hours. If no other towers has less than 100 hours more run time, the tower with the least running time is selected as the primary heating tower at block 64, the heating tower being started and operated at block 92. If there are other towers having less than 100 hours, the system determines at block 66 which of those same towers has the least number of stop and starts. At decision block 68, the system decides if any of those same towers have less than 20 (a number that can vary) stop-starts more than the tower with the least stop-starts. If no other towers has less than 20 more stop-starts, the system selects the tower with the least stop-starts as the primary heating tower at block 70, the heating tower being started and operated at block 94. If there is more than one tower having less than 20 more stop-starts, than the system determines at block 72 which of those same towers has the least number of failures. The tower with the least number of failures is selected as the primary heating tower at block 74, the heating tower being started and operated at block 96.

The system then reads flow demand at block 75 and proceeds to decision block 77 and decides if flow demand has increased beyond the capacity of the primary heater. If not, the system decides at decision block 79 if flow demand has reduced below the need for multiple heating towers for longer than 10 minutes. If yes, the smallest primary heater is shut down at block 85 and the system control returns to the read flow demand block 75. If the primary heater should not be shut down, the system returns to block 75 and reads flow demand. At decision block 77, if flow demand has increased beyond the capacity of the primary heater, the system proceeds to block 83 and determines demand deficiency required to be satisfied by secondary heating tower heating capacity by subtracting maximum heating capacity of the selected primary heating towers from measured output demand for the selected primary heating towers.

At decision block 54, if more than one heating tower is required to satisfy flow demand, the system determines at block 76, which inoperable heating towers are set for maintenance repair via manual input to the system at 78. Those heating towers not being scheduled for maintenance repair are considered capable of being started. At block 80, the system selects the largest heating tower capable of being started as a primary heating tower. At decision block 82, the system decides if only one more heating tower is required to satisfy flow demand. If so, the system at block 84, selects the smallest heating tower that, when added to the capacity of the largest heating tower selected, satisfies the flow demand. Both the largest and the smallest heating towers are considered primary heating towers. If at least 2 more heating towers are required to satisfy flow demand, the system selects the next largest heating tower as an additional primary tower at block 98. The system then returns to decision block 82 to determine once again if only one more heating tower need be selected to satisfy flow demand. Upon selecting the required quantity of primary heating towers to satisfy flow demand, the system then reads flow demand at block 75 and proceeds to decision block 77 to repeat the steps detailed, supra.

After the system determines demand deficiency at block 83, the system proceeds to decision block 100 and after reviewing the capacity of all remaining operable heating towers, decides if more than one heating tower is required to satisfy flow demand. If not, the system at decision block 102 decides if more than one tower has the required capacity, if not, that heating tower is selected as the secondary heating tower at block 104, the heating tower being started and operated via typical circuitry at block 152. If more than one heating tower has the required capacity, the system at block 106 determines which of the towers has the least running hours.

At decision block 108, the system decides if other towers having sufficient capacity have less than 100 (a number that can vary) hours more run time than the tower with the least running hours. If no other towers has less than 100 hours more run time, the tower with the least running time is selected as the primary heating tower at block 110, the heating tower being started and operated at block 154. If there are other towers having less than 100 hours, the system determines at block 112 which of those same towers has the least number of stop and starts. At decision block 114, the system decides if any of those same towers have less than 20 (a number that can vary) stop-starts more than the tower with the least stop-starts. If no other towers has less than 20 more stop-starts, the system selects the tower with the least stop-starts as the primary heating tower at block 116, the heating tower being started and operated at block 156. If there is more than one tower having less than 20 more start-stops, than the system determines at block 118 which of those same towers has the least number of failures. The tower with the least number of failures is selected as the secondary heating tower at block 120, the heating tower being started and operated at block 158.

The system then reads flow demand at block 122 and proceeds to decision block 124 and decides if flow demand has increased beyond the capacity of the secondary heater. If not, the system decides at decision block 126 if flow demand has reduced below the need for multiple heating towers for more than 10 minutes. If so, the smallest secondary heater is shut down at block 132 via components in a shutdown circuit (well known to those of ordinary skill) and the system returns to the read flow demand block 75. If the secondary heater should not be shut down, the system returns to block 122 and reads flow demand. At decision block 124, if flow demand has increased beyond the capacity of the secondary heater, the system proceeds to block 130 and determines demand deficiency required to be satisfied by another secondary heating tower by subtracting maximum heating capacity of the selected primary and secondary heating towers from measured output demand for the selected primary and secondary heating towers. The system then returns to decision block 100 to repeat the selection steps.

At decision block 100, if more than one heating tower is required to satisfy flow demand, the system determines at block 134, which inoperable heating towers are set for maintenance repair via manual input to the system at 136. Those heating towers not being scheduled for maintenance repair are considered capable of being started. At block 138, the system selects the largest heating tower capable of being started as a secondary heating tower. At decision block 140, the system decides if only one more heating tower is required to satisfy flow demand. If so, the system at block 142, selects the smallest heating tower that, when added to the capacity of the largest heating tower selected, satisfies the flow demand. Both the largest and the smallest heating towers are considered secondary heating towers. If at least 2 more heating towers are required to satisfy flow demand, the system selects the next largest heating tower as an additional secondary tower at block 150. The system then returns to decision block 140 to determine once again if only one more heating tower need be selected to satisfy flow demand. Upon selecting the required quantity of secondary heating towers to satisfy flow demand, the system then reads flow demand at block 122 and proceeds to decision block 124 to repeat the steps detailed, supra.

While the invention has been described with reference to the details of the embodiment, these details are not intended to limit the scope of the invention as defined in the appended claims.

What is claimed is:

1. A control system for multiple heating towers comprising:

means for selecting at least one of a plurality of heating towers as a primary heating tower;

means for starting said selected primary heating tower;

means for operating said selected primary heating tower;

means for selecting at least one of a plurality of heating towers as a secondary heating tower;

means for starting said selected secondary heating tower when predetermined demand parameters are required of said selected primary heating tower; and means for operating said selected secondary heating tower, said operating means for said selected secondary heating tower includes means for disabling said selected secondary heating tower whereby a minimum heating capacity is generated that corresponds to the low firing rate of the smallest primary tower thereby increasing the turndown ratio of the multiple heating towers.

2. The control system of claim 1 wherein said selecting, starting and operating means for said selected primary heating tower include an electrical relay system.

3. The control system of claim 1 wherein said selecting, starting and operating means for said selected primary heating tower include a computer control system.

4. The control system of claim 1 wherein said selecting, starting and operating means for said selected primary heating tower include a programmable logic controller.

5. The control system of claim 1 wherein said selecting, starting and operating means for said selected secondary heating tower include an electrical relay system.

6. The control system of claim 1 wherein said selecting, starting and operating means for said selected secondary beating tower include a computer control system.

7. The control system of claim 1 wherein said selecting, starting and operating means for said selected secondary heating tower include a programmable logic controller.

8. The control system of claim 1 wherein said predetermined demand parameters include flow demand.

9. The control system of claim 1 wherein said selecting means for said primary and secondary heating towers include means for alternating the selection of primary and secondary heating towers from said plurality of heating towers whereby wear is distributed evenly between all of said plurality of heating towers.

10. The control system of claim 1 wherein said operating means for said selected primary and secondary heating towers include indicator means for providing the operating temperature of said selected primary and secondary heating towers.

11. The control system of claim 1 wherein said operating means for said selected primary and secondary heating towers include means for adjusting the operating temperature of said selected primary and secondary heating towers.

12. The control system of claim 1 wherein said selected primary and secondary heating towers are utilized to heat water.

13. The control system of claim 1 wherein said selecting means for selecting at least one of a plurality of heating towers as a primary heating tower includes means for determining the number of start and stops for each operable heating tower.

14. A method for heating liquids and distributing operating wear amongst a plurality of heating towers, said method comprising the steps of:

determining operable heating towers from a plurality of heating towers;

determining initial flow demand;

determining the temperature that the initial flow demand is to be heated;

selecting at least one primary heating tower from said operable heating towers, said selected primary heating tower satisfying initial flow demand at said determined temperature, said step of selecting at least one primary heating tower includes the step of determining the number of starts and stops for each operable heating tower:

starting said selected primary heating tower;

operating said selected primary heating tower;

determining when flow demand has increased beyond the heating capacity of said primary heating tower;

selecting at least one secondary heating tower from said operable heating towers, said selected secondary heating tower satisfying increased flow demand at said determined temperature;

starting said selected secondary heating tower; and operating said selected secondary heating tower.

15. The method of claim 14 wherein the step of selecting at least one primary heating tower includes the step of determining the running hours of operation for each operable heating tower.

16. The method of claim 14 wherein the step of operating said selected secondary heating tower includes the step of disabling said selected secondary heating tower whereby a minimum heating capacity is generated that corresponds to the low firing rate of the smallest primary tower thereby increasing the turndown ratio of the multiple heating towers.

17. The method of claim 14 wherein the step of selecting at least one primary heating tower includes the step of determining the quantity of failures for each operable heating tower.

18. The method of claim 14 wherein the step of selecting at least one secondary heating tower includes the step of determining the running hours of operation for each operable heating tower.

19. A method for heating liquids and distributing operating wear amongst a plurality of heating towers, said method comprising the steps of:

determining operable heating towers from a plurality of heating towers;

determining initial flow demand;

determining the temperature that the initial flow demand is to be heated;

selecting at least one primary heating tower from said operable heating towers, said selected primary heating tower satisfying initial flow demand at said determined temperature; starting said selected primary heating tower;

operating said selected primary heating tower;

determining when flow demand has increased beyond the heating capacity of said primary heating tower;

selecting at least one secondary heating tower from said operable heating towers, said selected secondary heating tower satisfying increased flow demand at said determined temperature, said step of selecting at least one secondary heating tower from said operable heating towers includes the step of determining the number of starts and stops for each operable heating tower;

starting said selected secondary heating tower; and operating said selected secondary heating tower.

20. The method of claim 14 wherein the step of selecting at least one secondary heating tower includes the step of determining the quantity of failures for each operable heating tower.

21. A method for controlling multiple heating towers, said method comprising the steps of:

selecting at least one of a plurality of heating towers as a primary heating tower, said step of selecting at least one primary heating tower includes the step of determining the number of starts and stops for each heating tower;

starting said selected primary heating tower;

operating said selected primary heating tower;

selecting at least one of a plurality of heating towers as a secondary heating tower;

starting said selected secondary heating tower when predetermined demand parameters are required of said selected primary heating tower; and operating said selected secondary heating tower.

22. The method of claim 21 wherein the step of selecting at least one primary heating tower includes the step of manually selecting a primary heating tower.

23. The method of 21 wherein the step of selecting at least one primary heating tower includes the step of utilizing electrical control and/or computer means for selecting a primary heating tower.

24. The method of claim 21 wherein the step of selecting at least one primary heating tower includes the step of determining inoperable heating towers.

25. The method of claim 21 wherein the step of selecting at least one primary heating tower includes the step of totaling running hours of operation for each heating tower.

26. The method of claim 21 wherein the step of selecting at least one secondary heating tower includes the step of disabling said selected secondary heating tower whereby a minimum heating capacity is generated that corresponds to the low firing rate of the smallest primary tower thereby increasing the turndown ratio of the multiple heating towers.

27. The method of claim 21 wherein the step of operating said selected primary heating tower includes the step of disabling said selected primary heating tower.

28. A method for controlling multiple heating towers, said method comprising the steps of:

selecting at least one of a plurality of heating towers as a primary heating tower, the step of selecting a primary heating tower includes the step of determining the time of day, wherein the step of determining the time of day includes the step of selecting a low flow or high flow condition;

starting said selected primary heating tower;

operating said selected primary heating tower;

selecting at least one of a plurality of heating towers as a secondary heating tower;

starting said selected secondary heating tower when predetermined demand parameters are required of said selected primary heating tower; and operating said selected secondary heating tower.

29. The method of claim 28 wherein the step of selecting a low flow or high flow condition includes the step of determining the quantity of heating towers required that correspond to the selected low or high flow condition.

30. A method for controlling multiple heating towers, said method comprising the steps of:

selecting at least one of a plurality of heating towers as a primary heating tower. The step of selecting at least one primary heating tower includes the step of determining the quantity of failures for each heating tower;

starting said selected primary heating tower;

operating said selected primary heating tower;

selecting at least one of a plurality of heating towers as a secondary heating tower;

starting said selected secondary heating tower when predetermined demand parameters are required of said selected primary heating tower; and operating said selected secondary heating tower.

31. The method of claim 24 wherein the step of determining inoperable heating towers includes the step of determining which inoperable heating towers have been designated

32. A method for controlling multiple heating towers, said method comprising the steps of:

selecting at least one of a plurality of heating towers as a primary heating tower; the step of selecting a primary heating tower includes the step of determining inoperable heating towers. the step of determining inoperable heating towers includes the step of determining which inoperable heating towers have not been designated for maintenance repair;

starting said selected primary heating tower;

operating said selected primary heating tower;

selecting at least one of a plurality of heating towers as a secondary heating tower;

starting said selected secondary heating tower when predetermined demand parameters are required of said selected primary heating tower; and operating said selected secondary heating tower.

33. A method for controlling multiple heating towers, said method comprising the steps of:

selecting at least one of a plurality of heating towers as a primary heating tower; wherein the step of selecting a primary heating tower includes the step of determining if more than one primary heating tower is required to satisfy initial demand;

starting said selected primary heating tower;

operating said selected primary heating tower;

selecting at least one of a plurality of heating towers as a secondary heating tower;

starting said selected secondary heating tower when predetermined demand parameters are required of said selected primary heating tower; and operating said selected secondary heating tower.

34. The method of claim 33 wherein the step of determining if more than one primary heating tower is required to satisfy initial demand includes the step of providing the maximum heating capacity for each heating tower.

35. The method of claim 21 wherein the step of selecting at least one secondary heating tower includes the steps of determining the maximum heating capacity of the selected primary heating towers, measuring the output demand for the selected primary heating towers, and calculating the demand deficiency required to be satisfied by secondary heating tower heating capacity.

36. A method for controlling multiple heating towers, said method comprising the steps of:

selecting at least one of a plurality of heating towers as a primary heating tower;

starting said selected primary heating tower;

operating said selected primary heating tower;

selecting at least one of a plurality of heating towers as a secondary heating tower, the step of selecting at least one secondary heating tower includes the steps of determining the maximum heating capacity of the selected primary heating towers, measuring the output demand for the selected primary heating towers, calculating the demand deficiency required to be satisfied by the secondary heating tower heating capacity, and manually selecting a secondary heating tower;

starting said selected secondary heating tower when predetermined demand parameters are required of said selected primary heating tower; and operating said selected secondary heating tower.

37. The method of claim 21 wherein the step of selecting at least one secondary heating tower includes the step of utilizing electrical and/or computer control means for selecting a secondary heating tower.

38. The method of claim 21 wherein the step of selecting at least one secondary heating tower includes the step of determining inoperable heating towers.

39. The method of claim 21 wherein the step of selecting at least one secondary heating tower includes the step of totaling running hours of operation for each heating tower.

40. A method for controlling multiple heating towers, said method comprising the steps of;

selecting at least one of a plurality of heating towers as a primary heating tower;

starting said selected primary heating tower;

operating said selected primary heating tower;

selecting at least one of a plurality of heating towers as a secondary heating tower, the step of selecting a secondary heating tower includes the step of determining the number of start and stops for each heating tower;

starting said selected secondary heating tower when predetermined demand parameters are required of said selected primary heating tower; and operating said selected secondary heating tower.

41. A method for controlling multiple heating towers, said method comprising the steps of;

selecting at least one of a plurality of heating towers as a primary heating tower;

starting said selected primary heating tower;

operating said selected primary heating tower;

selecting at least one of a plurality of heating towers as a secondary heating tower, the step of selecting at least one secondary heating tower includes the steps of determining the maximum heating capacity of the selected primary heating towers, measuring the output demand for the selected primary heating towers, calculating the demand deficiency required to be satisfied by secondary heating tower heating capacity, and the time of day;

starting said selected secondary heating tower when predetermined demand parameters are required of said selected primary heating tower; and operating said selected secondary heating tower.

42. The method of claim 41 wherein the step of determining the time of day includes the step of selecting a low flow or high flow condition.

43. The method of claim 42 wherein the step of selecting a low flow or high flow condition includes the step of determining the quantity of heating towers required that correspond to the selected low or high flow condition.

44. The method of claim 41 wherein the step of selecting at least one secondary heating tower includes the step of determining the quantity of failures for each heating tower.

45. The method of claim 41 wherein the step of determining inoperable heating towers includes the step of determining which inoperable heating towers have been designated for maintenance repair.

46. A method for controlling multiple heating towers, said method comprising the steps of;

selecting at least one of a plurality of heating towers as a primary heating tower;

starting said selected primary heating tower;

operating said selected primary heating tower;

selecting at least one of a plurality of heating towers as a secondary heating tower, the step of selecting a secondary heating tower includes the step of determining inoperable heating towers, wherein the step of determining inoperable heating towers includes the step of determining which inoperable heating towers, not designated for maintenance repair, are capable of being selected as a primary heater;

starting said selected secondary heating tower when predetermined demand parameters are required of said selected primary heating tower; and operating said selected secondary heating tower.

47. A method for controlling multiple heating towers, said method comprising the steps of;

selecting at least one of a plurality of heating towers as a primary heating tower;

starting said selected primary heating tower;

operating said selected primary heating tower;

selecting at least one of a plurality of heating towers as a secondary heating tower, the step of selecting at least one secondary heating tower includes the steps of determining the for the selected primary heating towers, calculating the demand deficiency required to be satisfied by secondary heating tower heating capacity, and if more than one secondary heating tower is required to satisfy initial demand;

starting said selected secondary heating tower when predetermined demand parameters are required of said selected primary heating tower; and operating said selected secondary heating tower.

48. The method of claim 47 wherein the step of determining if more than one secondary heating tower is required to satisfy initial demand includes the step of providing the maximum heating capacity for each heating tower.

49. A method for controlling multiple heating towers, said method comprising the steps of;

selecting at least one of a plurality of heating towers as a primary heating tower;

starting said selected primary heating tower;

operating said selected primary heating tower;

selecting at least one of a plurality of heating towers as a secondary heating tower, the step of selecting at least one secondary heating tower includes the steps of designating all operating heating towers as primary heating towers, determining the maximum heating capacity of the designated primary heating towers, measuring the output demand for the designated primary heating towers, and calculating the demand deficiency required to be satisfied by secondary heating tower heating capacity;

starting said selected secondary heating tower when predetermined demand parameters are required of said selected primary heating tower; and operating said selected secondary heating tower.

* * * * *

UNITED STATES PATENT AND TRADEMARK OFFICE

CERTIFICATE OF CORRECTION

PATENT NO. : 6,831,257 B2
DATED : December 14, 2004
INVENTOR(S) : Brian Keith Walker It is certified that error appears in the above-identified patent and that said Letters Patent is hereby corrected as shown below:

Column 7,
Line 9, change “beating” to -- heating --

Signed and Sealed this

Twenty-second Day of February, 2005

JON W. DUDAS
*Director of the United States Patent and Trademark Office*